US005444871A

United States Patent [19]

Lopez

[11] Patent Number: 5,444,871

[45] Date of Patent: Aug. 29, 1995

[54] MEDICAL GOWN WITH SEAMLESS SLEEVE PROTECTOR

[75] Inventor: Francisco G. Lopez, El Paso, Tex.

[73] Assignee: Johnson & Johnson Medical, Inc., Arlington, Tex.

[21] Appl. No.: 97,359

[22] Filed: Jul. 26, 1993

[51] Int. Cl.[6] ..... A41D 13/00

[52] U.S. Cl. ..... 2/114; 2/59

[58] Field of Search ..... 2/16, 60, 59, 114, 113, 2/115, 123, 124, 125, 126, 160, 161, 244, 243.1, 69, 82, 85, 86, 87, 108

[56] References Cited

U.S. PATENT DOCUMENTS

| | | | |
|---|---|---|---|
| 3,045,815 | 7/1962 | Abildgaard | 2/114 |
| 3,129,432 | 4/1964 | Belkin | 2/114 |
| 3,657,741 | 4/1972 | Blanco | 2/59 |
| 3,721,997 | 3/1973 | Mundt | 2/46 |
| 3,868,728 | 3/1975 | Krzewinski . | |
| 4,356,570 | 11/1982 | Vernon et al. | 2/59 |
| 4,369,528 | 1/1983 | Vest et al. | 2/69 |
| 4,543,670 | 10/1985 | Ehring | 2/124 |
| 4,631,753 | 12/1986 | Ehring | 2/124 |
| 4,932,078 | 6/1990 | Jones et al. | 2/70 |
| 4,951,317 | 8/1990 | Gray et al. | 2/59 X |
| 5,063,919 | 11/1991 | Silverberg | 2/59 |
| 5,088,116 | 2/1992 | Gould | 2/126 X |
| 5,271,100 | 12/1993 | Holt . | |

FOREIGN PATENT DOCUMENTS

| | | | |
|---|---|---|---|
| 287546 | 5/1928 | United Kingdom . | |
| 730650 | 5/1955 | United Kingdom | 2/DIG. 2 |

*Primary Examiner*—Jeanette E. Chapman
*Attorney, Agent, or Firm*—James Riesenfeld; Andrew C. Farmer

[57] ABSTRACT

A medical gown has a tubular, seamless, and impervious protective layer surrounding each sleeve to provide enhanced protection from contamination, particularly during surgical procedures. The bottom end of the protective layer is attached to the sleeve cuff and the top end preferably extends at least 70% of the distance to the shoulder seam. The protective layer may be of polyethylene or other suitable material, and the top end may be adhered to the sleeve by commonly used adhesives.

14 Claims, 3 Drawing Sheets

FIG. 2
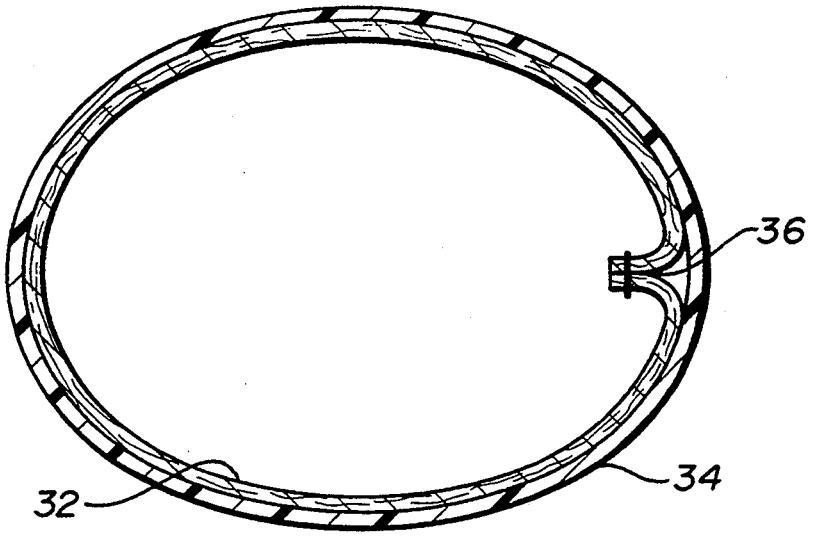
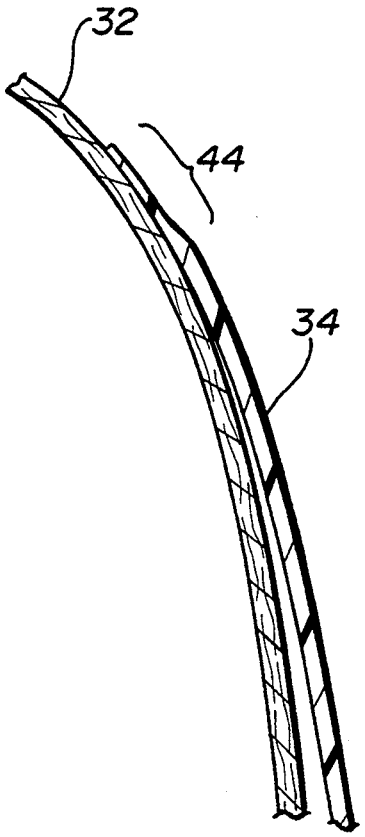
FIG. 3

MEDICAL GOWN WITH SEAMLESS SLEEVE PROTECTOR

BACKGROUND OF THE INVENTION

1. Field of the Invention

This invention relates to a medical gown that provides enhanced protection from contamination during surgical procedures.

2. Description of the Related Art

Medical gowns serve the important purpose of preventing transmission of contaminants between a patient and a healthcare worker. Their role is particularly important when a healthcare worker wearing the gown is involved in a surgical procedure that potentially exposes the worker to blood and other body fluids that may carry dangerous microbes. When involved in such surgical procedures, the hands and arms of the worker are often exposed to these potentially dangerous fluids and must, therefore, be protected. Surgical gloves, of latex or other impervious material, commonly protect the hands, but surgical gowns, both disposable—typically nonwoven—and reusable, are subject to fluid strike-through, which can expose the arms to risk. For reusable gowns, the strike-through risk increases with repeated laundering. For that reason and others, disposable gowns are generally preferred. In disposable gowns, to counter the strike-through risk, gowns have been available with sleeves formed of a nonwoven/plastic laminate or with sleeves having an impervious material on the inside or outside of the the nonwoven. Although these reinforced sleeves reduce the risk of exposure to contamination, their axial seams have provided a route for potential microbial transmission.

U.K. Patent 287,546, issued on May 3, 1928, to H. Pechadre, discloses a removable sleeve for protecting the wrist and forearm of the wearer. The sleeve is designed primarily for motor vehicle users who must look after their vehicles while wearing their "city clothes."

U.S. Pat. No. 3,721,997, issued on Mar. 27, 1973, to T. I. Mundt, discloses a seamless, plastic protective garment of tubular design to be worn temporarily over normal human apparel during inclement weather.

U.S. Pat. No. 4,369,528, issued on Jan. 25, 1983, to H. R. Vest et al., discloses a garment for maintaining the body temperature of a patient undergoing surgery. The garment includes a pair of tubular knit seamless sleeves.

U.S. Pat. No. 4,932,078, issued on Jun. 12, 1990, to R. S. Jones et al., discloses a garment that protects its wearer from particulate matter in the surrounding atmosphere. The garment includes cuffs having seams that are sealed with tape in order to prevent particle transmission.

None of these references have disclosed a simple structure that provides a permanent impervious barrier to the transmission of microbial contaminants between a patient and a healthcare worker during surgery.

SUMMARY OF THE INVENTION

In accordance with the present invention, a medical gown is provided that gives enhanced protection from contamination and that includes a body portion and two sleeve portions. Each sleeve portion comprises a) a sleeve having a first end attached to a cuff and a second end attached to the body portion, b) a tubular, seamless, and impervious protective layer having a first end attached to the outside of the sleeve adjacent to the cuff, and a second end attached between the first and second ends of the sleeve.

Further, the present invention provides a method of forming an enhanced-protection medical gown of the type that includes a body portion attached to two cuffed sleeve portions, comprising attaching to the outside of each sleeve portion a tubular, seamless, and impervious protective layer that extends from the cuff at least half the distance to the body portion.

The present invention provides a gown that is simple in construction and that provides enhanced protection from the transmission of contaminants, when compared with gowns whose sleeves have seams that can be exposed to fluid-borne pathogens.

BRIEF DESCRIPTION OF THE DRAWINGS

FIG. 2 is a cross section through the reinforced sleeve of the gown of FIG. 1.

FIG. 3 is another cross section through the reinforced sleeve of FIG. 1.

DETAILED DESCRIPTION OF THE INVENTION

Surgical procedures expose members of the surgical team to blood and other fluids that may contain pathogens. It is important that these workers, particularly their hands and arms, be protected from contamination.

Gloves, typically made of latex, protect the hands, while arm protection is provided by medical gowns. Conventional medical gowns, even when their sleeves have been reinforced with an impervious material, have not provided healthcare workers assured protection from potential exposure to contaminated fluids. Due in part to the "wicking" tendency of both woven and nonwoven fabrics, the fluid can find its way through the seams that typically run the length of the sleeve and of the reinforcement.

The present invention provides a gown that guards against contamination more effectively than do earlier gowns.

Figure 1:
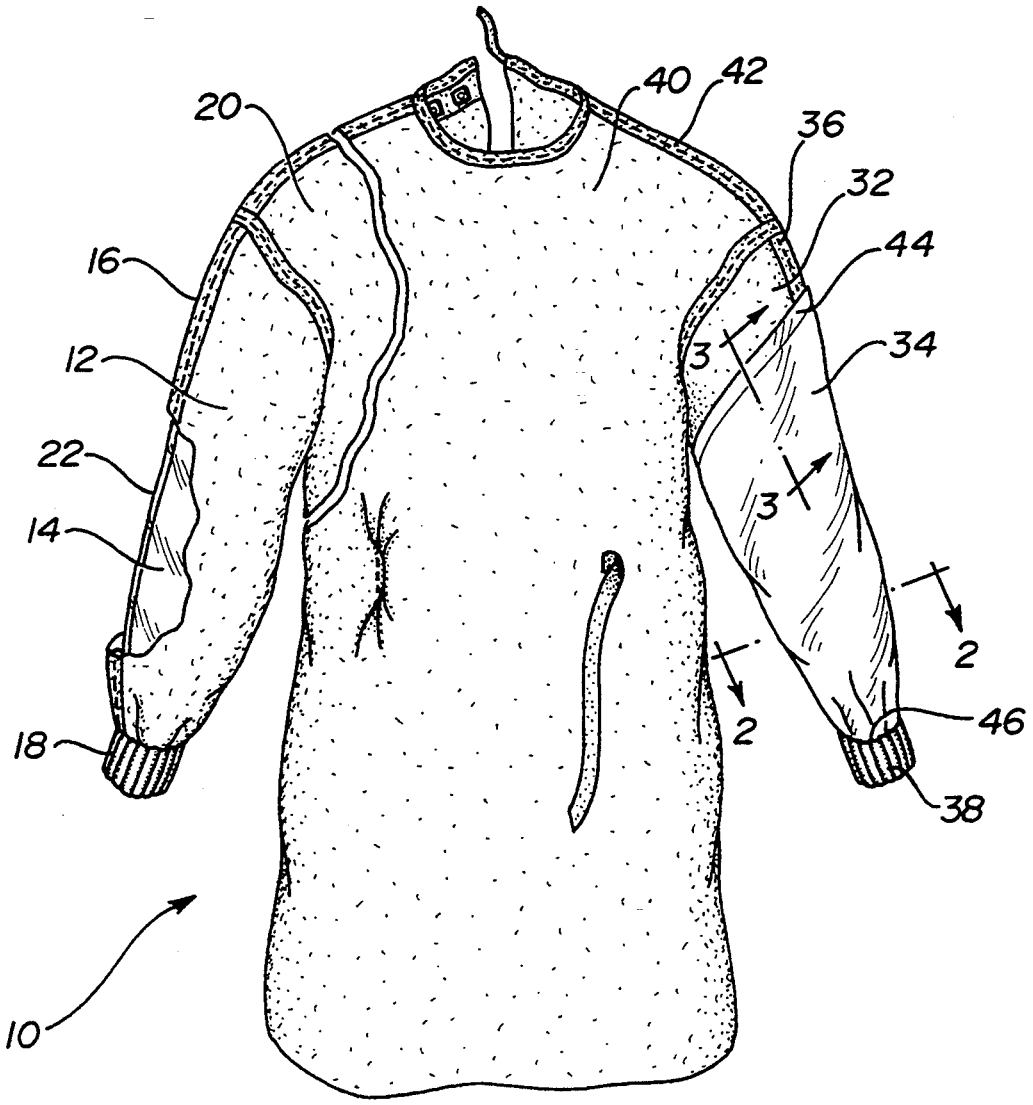
FIG. 1 is a perspective view of a medical gown of the present invention with a cutaway view of a sleeve of the prior art.

FIG. 1 depicts a gown of the present invention 10 whose right sleeve and a segment of the adjoining body portion have been cut away and replaced with a conventional sleeve 12 and segment of body portion. Typically, gown 10, as well as conventional sleeve 12, are formed from a durable woven or disposable nonwoven fabric. Conventional sleeve 12 is reinforced on its inside by impervious layer 14. Seam 16, runs along the entire sleeve length from cuff 18 to the body section 20. Seam 22 runs the length of reinforcement 14.

FIG. 1 depicts reinforcement 14 on the inside of sleeve 12. That arrangement introduces a potential contamination problem when blood passes through sleeve 12 and runs between it and impervious layer 14 to cuff 18. Blood can then contact the wrist, and if the arm is raised the blood can run down the arm. Furthermore, when that arrangement is used, a second fabric layer (not shown) is generally placed on the inside of reinforcement 14. This prevents contact (which tends to be uncomfortable) between the impervious material of layer 14 and the arm. Alternatively, the reinforcing layer may be on the outside of sleeve 12. In either case, the presence of seams 22 and 16 make the sleeve vulnerable to microbial transmission. The vulnerability is greater when the fabric and reinforcement material have a common seam which can simplify fabrication—but it is not eliminated by laterally displacing the seams, as depicted in FIG. 1. Diffusion of the fluid along and through the fabric (i.e., wicking) contributes to the risk of fluid contamination.

The remainder of FIG. 1 depicts the gown of the present invention; in particular, sleeve 32. Sleeve 32 is surrounded over part of its length by seamless tubular protective layer 34, thereby providing an impervious barrier, as is depicted in cross section in FIG. 2. Protective layer 34 isolates the lower end of seam 36 from cuff 38 to a point that is at least half the distance from the top of cuff 38 to the body portion 40, more preferably about 70%–100% of the distance. Seam 42 joins body portion 40 to sleeve 32 and marks the top end of the sleeve. Protective tube 34 may be any elastomeric or thermoplastic that can be formed into a seamless, impervious tube, such as latex rubber, Kraton® thermoplastic rubber, polyethylene, and polypropylene. The tube may also be a breathable microporous or monolithic material, such as those sold under the trademarks Hytrel® and Goretex®. Thermoplastics are preferred, with polyethylene particularly preferred, because it is readily available and inexpensive. The top end 44 of protective tube 34 is joined to sleeve 32 without sewing, using thermal bonding, adhesives, or any other attachment method known in the art. Adhesives, such as hot melt, acrylic, or latex adhesives, are preferred. FIG. 3 is a cross section through sleeve 32 and protective layer 34, showing area 44 over which the two layers are adhered.

A convenient way of joining the bottom end of tube 34 to sleeve 32 is to attach it in a common seam 46 with cuff 38. That seam does not pose a potential contamination risk, because it is covered by a glove during a surgical procedure.

Figures 4, 5, 6:
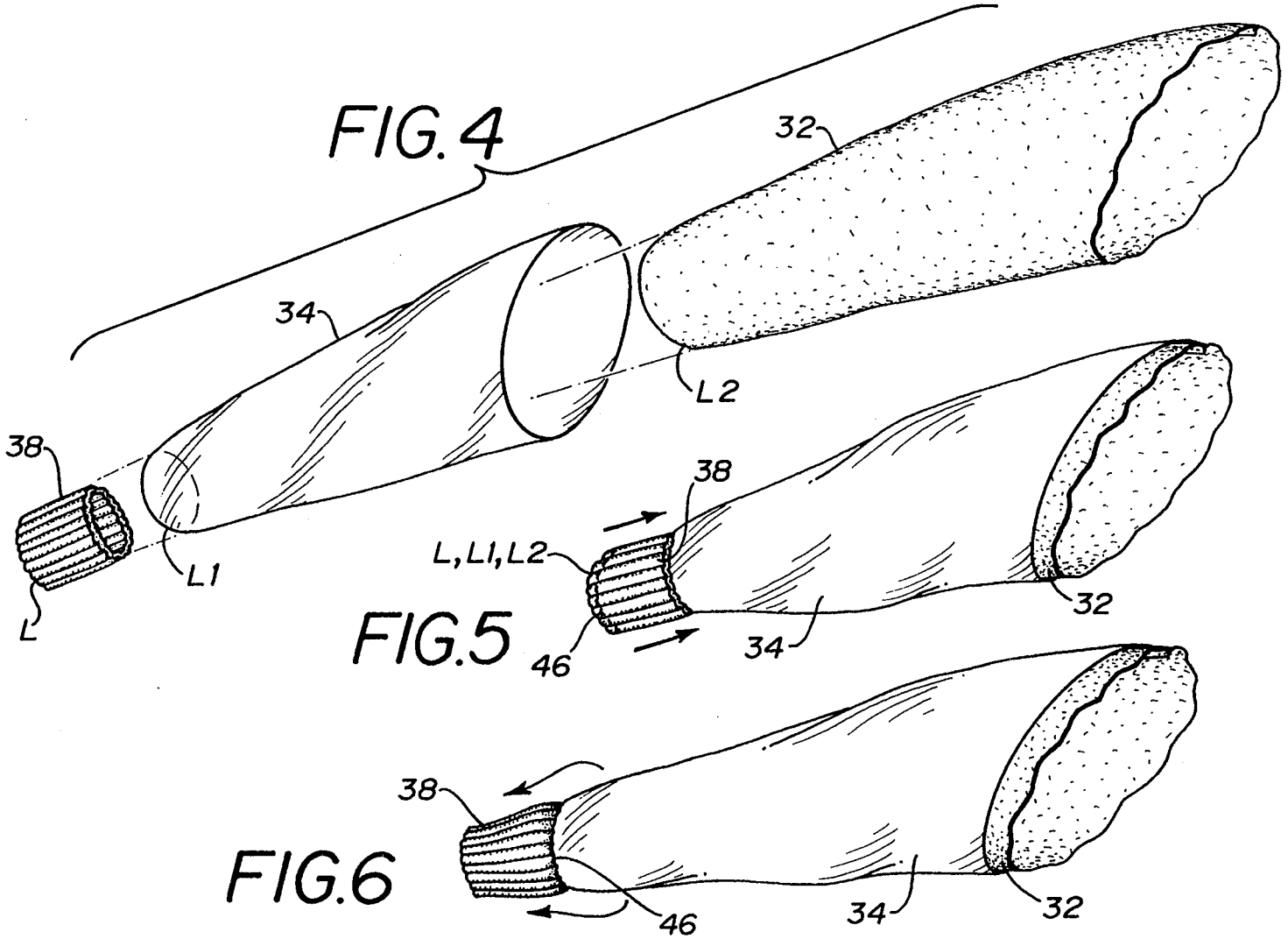
FIG. 4 is an exploded view of the elements of the reinforced sleeve of FIG. 1.
FIG. 5 shows the elements of FIG. 4 after they have been assembled.
FIG. 6 shows the final appearance of the elements of FIG. 4.

FIGS. 4, 5, and 6 depict the sequence of steps in a method of forming an enhanced-protection gown of the present invention. FIG. 4 is an exploded view showing knitted cuff 38, tubular layer 34, and the lower end of sleeve 32.

In FIG. 4, knitted cuff 38 is inside out. Cuff 38 is pulled over layer 34 and sleeve 3.2 and its left end L is sewn to the left ends L1 of protective layer 34 and L2 of sleeve 32 to yield the assembled configuration of FIG. 5. Seam 46 joins both cuff 38 and reinforcement tube 34 to the bottom end of sleeve 32. Cuff 38 is then turned right side out to yield the final configuration shown in FIG. 6.

I claim:

1. A medical gown for use with an elastomeric surgical glove and that includes a body portion and two sleeve portions, in which each sleeve portion comprises:

a) a sleeve having a first end attached to a cuff, a second end attached to the body portion, and an outside surface; and b) a tubular, seamless, and impervious protective layer surrounding the sleeve and having a first end permanently attached to the sleeve adjacent to the cuff and engageable by the glove, and a second end permanently attached to the outside surface of the sleeve between the first and second ends of the sleeve;

whereby when the sleeve is placed over a user's arm and the surgical glove is placed over a user's hand with the glove coveting the cuff and engaging the protective layer first end, wicking along the sleeve and beneath the glove of fluid which has splattered onto the sleeve is inhibited.

2. A medical gown according to claim 1 in which the composition of the protective layer comprises a thermoplastic.

3. A medical gown according to claim 2 in which the composition of the protective layer is polyethylene.

4. A medical gown according to claim 1 in which the protective layer comprises a breathable material.

5. A medical gown according to claim 1 in which the length of the protective layer is about 70–100% of the length of the sleeve.

6. A medical gown according to claim 1 in which a common seam joins the first end of the protective layer and the cuff to the sleeve.

7. A method of forming an enhanced-protection medical gown of the type that includes a body portion attached to two cuffed sleeve portions and a tubular, seamless, and impervious protective layer around each sleeve, comprising (a) extending the protective layer from the cuff at least half the distance to the body;

(b) stitching the first end of the protective layer to the first end of the sleeve; and (c) adhering the second end of the protective layer to the sleeve without sewing.

8. A method for protecting medical personnel from bodily fluids of a patient during a medical procedure comprising the steps of:

providing a medical gown that includes a body portion and two sleeve portions, each sleeve portion comprising a sleeve having a first end attached to a cuff, a second end attached to the body portion, and an outside surface;

surrounding at least a portion of each sleeve with a tubular, seamless and impervious protective layer;

permanently attaching a first end of each protective layer to the first end of the corresponding sleeve adjacent the cuff;

permanently attaching a second end of each protective layer to the outside surface of the corresponding sleeve between its first and second ends;

donning the gown onto a medical worker, including placing the worker's arms through the gown sleeve portions;

donning elastomeric surgical gloves onto the hands of the medical worker; and pulling the surgical gloves over the cuffs and into sealing engagement with the protective layer first ends;

whereby fluid splashed onto one of the protective layers is inhibited from entering the associated glove by the sealing engagement between the protective layer and the glove.

9. A method according to claim 8 and further comprising the step of forming the protective layer from a thermoplastic.

10. A method according to claim 8 and further comprising the step of forming the protective layer from polyethylene.

11. A method according to claim 8 and further comprising the step of forming the protective layer from a breathable material.

12. A method according to claim 8 wherein the steps of permanently attaching the protective layers to the sleeves comprises adhesively bonding the protective layers to the sleeves.

13. A medical gown according to claim 1 wherein the protective layer second ends are adhesively bonded to the sleeves to form an impervious seal therewith.

14. A medical gown according to claim 13 wherein the protective layers are adhesively bonded to the sleeves over substantially the entire lengths of the protective layers.

* * * * *